United States Patent [19]

Work, III et al.

[11] 4,181,528

[45] Jan. 1, 1980

[54] SUBBING COMPOSITION COMPRISING TREATED GELATIN-POLYESTER-AZIRIDINE MATERIAL FOR ADHERING PHOTOGRAPHIC EMULSION TO POLYESTER FILM BASE

[75] Inventors: Ray A. Work, III, Hendersonville, N.C.; Richard P. Pankratz, Circleville, Ohio

[73] Assignee: E. I. Du Pont de Nemours and Company, Wilmington, Del.

[21] Appl. No.: 887,344

[22] Filed: Mar. 20, 1978

Related U.S. Application Data

[63] Continuation-in-part of Ser. No. 827,594, Aug. 25, 1977, which is a continuation-in-part of Ser. No. 791,516, Apr. 27, 1977, abandoned.

[51] Int. Cl.[2] ..... G03C 1/04

[52] U.S. Cl. ..... 428/474; 430/532; 430/533

[58] Field of Search ..... 96/87 R, 114, 114.7; 260/7.5

[56] References Cited

U.S. PATENT DOCUMENTS

| | | | |
|---|---|---|---|
| 2,009,029 | 3/1932 | Sly | 260/7.5 |
| 3,434,840 | 3/1969 | Dekeyser et al. | 96/87 R |

OTHER PUBLICATIONS

Chem. Abstracts, vol. 75, col. 157025h.

*Primary Examiner*—John D. Welsh

[57] ABSTRACT

To improve adhesion of a hydrophilic photographic emulsion to a hydrophobic polyester film base the latter is pretreated by electrical discharge, flame or chemical treatment, and then given a sub-coating composed of an aqueous dispersion of gelatin, a water-soluble polyester, and a polyfunctional aziridine crosslinking agent, and this coating is then thermally cured.

4 Claims, No Drawings

SUBBING COMPOSITION COMPRISING TREATED GELATIN-POLYESTER-AZIRIDINE MATERIAL FOR ADHERING PHOTOGRAPHIC EMULSION TO POLYESTER FILM BASE

CROSS-REFERENCE TO RELATED APPLICATIONS

This is a continuation-in-part of application Ser. No. 827,594, filed Aug. 25, 1977, which in turn is a continuation-in-part of abandoned application Ser. No. 791,516, filed Apr. 27, 1977.

BACKGROUND OF THE INVENTION

This invention relates to photographic film elements, and is particularly concerned with transparent photographic film elements having an improved anchoring substratum (commonly known as a subbing layer) between the film base and the water-permeable colloid layer or layers disposed thereon.

It is common practice in the manufacture of photographic films to employ as a film support a dimensionally stable biaxially oriented heat set polyester such as polyethylene terephthalate. Polyethylene terephthalate films are conventionally prepared, for example, by catalytic ester-interchange reaction between dimethylterephthalate and ethylene glycol, followed by catalytic polymerization under vacuum of the resulting dihydroxyethylene terephthalate monomer. The final polymer is then cast as a film and biaxially oriented by stretching. Films made in this manner have a relatively hydrophobic surface, and do not adhere well to hydrophilic coatings containing gelatin. Accordingly, it is customary to employ several intermediate layers between the support and the photographic emulsion layer in order to effect suitable adhesion between the two. Generally, two intermediate layers are used. The first is a chlorine-containing copolymer resin coating applied to the polyester support after the latter has been cast into film but before it has been stretched to obtain the desired biaxial orientation and heat set. This resin coating provides good adhesion to the polyester, and at the same time provides good adhesion to the second subbing layer, which is applied after stretching and heat setting. This second layer is usually composed of a hydrophilic colloid such as gelatin, which in turn adheres well to the gelatin-containing photographic emulsion layer. Before applying the photographic emulsion layer, the dual-subbed polyester support is heat-relaxed to achieve dimensional stability.

The trouble with this system is that a certain amount of scrap film is formed in the process of biaxial orientation and heat setting of the polyester film, and it cannot be recycled because the first subbing layer has already been applied, and it is incompatible with the composition of the recycle. This prevents recycle of the polyester film unless the first subbing layer is removed beforehand, and its removal is costly and difficult, making this undesirable. As a result much film has to be discarded instead of being recycled. The present invention provides a solution to this problem.

SUMMARY OF THE INVENTION

In the present invention it has been found that if an aqueous dispersion of a product prepared by the reaction of gelatin, a water-soluble polyester polymer, and a polyfunctional aziridine is coated on polyethylene terephthalate film after the latter has been biaxially oriented, heat set, and then surface treated by electrical discharge, or flame or chemical treatment, that this single subbing layer will be firmly bonded to the polyester support and will also supply excellent wet and dry anchorage and adhesion to a photographic emulsion layer applied thereto. This not only eliminates the need for a second subbing layer, as is conventional, but it enables any scrap polyester film that was formed during the stretching step to be recycled, since the single subbing layer of this invention will not have been applied at that stage. In addition overall coating quality, and the cost of manufacture, is improved by eliminating one coating step.

DETAILED DESCRIPTION OF THE INVENTION

Generally the reaction product which is used in the single subbing layer of the present invention is prepared from a mixture of (1) gelatin, (2) a water-soluble polyester, e.g., the diethylene glycol or ethylene glycol polyesters of terephthalic acid, isophthalic acid, azelaic acid, and the sodium sulfonate salt of isophthalic acid, and (3) an aziridine crosslinking agent, preferably pentaerythritol tri-[$\beta$-(N-aziridinyl) propionate]. By "water-soluble" it is intended that the polyester be soluble in water or dispersible in water.

In general the water-soluble polyester should be employed in an amount of about 5–75 parts by weight, based on the weight of the dry reaction product, the poly-functional aziridine hardener should be employed in an amount of about 0.5–25 parts by weight, based on the weight of the dry reaction product; and the gelatin in an amount of 5–94.5 parts by weight, on the same basis. Any inert photographic-grade gelatin is operative. Of course, minor amounts of other additives may be present, as illustrated in the Examples.

The water-soluble polyester is a copolyester formed from one or more aliphatic diols, and terephthalic acid, isophthalic acid, an aliphatic dicarboxylic acid, and sodium dimethyl-5-sulfoisophthalate. Preferably, the aliphatic diols are ethylene glycol and diethylene glycol, employed in molar ratios of from 5:95% diethylene glycol:ethylene glycol, to 95:5%; and the dicarboxylic acid equivalents are supplied by the following acids: about 25–35% (molar) terephthalic acid; about 45–55% (molar) azelaic acid; about 15–20% (molar) isophthalic acid; and about 0.5–10% (molar) sodium 5-sulfoisophthalic acid. The function of the latter is to render the polyester water-dispersible, and accordingly enough must be used to accomplish this. Within these ranges it is particularly preferred to employ 80% (molar) diethylene glycol and 20% (molar) ethylene glycol, and the acid equivalents in the following amounts: about 30% (molar) terephthalic acid; about 45% (molar) azelaic; about 15% (molar) isophthalic acid; and about 10% (molar) sodium dimethyl-5-sulfoisophthalate. These copolyesters form excellent coating compositions in an aqueous medium.

In place of the ethylene glycol and diethylene glycol referred to above, other aliphatic diols of 3–10 carbon atoms may be employed, singly or in combination. The aliphatic dicarboxylic acid component is not limited to azelaic acid but could include other saturated aliphatic dicarboxylic acids, such as malonic, succinic, glutaric, adipic, pimelic, suberic, and sebacic.

While the preferred polyfunctional aziridine hardener is pentaerythritol-tri-[β-(N-aziridinyl)-propionate],

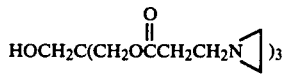

other polyfunctional aziridine hardeners can also be employed such as trimethylolpropane tri-[β-(N-aziridinyl)-propionate]

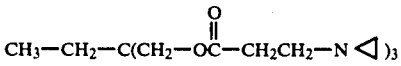

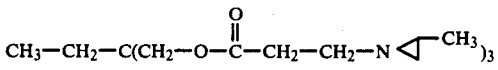

and any others that are reasonably soluble and stable in water, that contain at least two aziridine groups in order to effect crosslinking, and in the coating composition of this invention will effect a rapid and complete cure at the temperatures at which the coating composition is cured after it has been applied to the polyester support, e.g., about 130° C. in a time span of less than one minute.

Polyester films useful in the practice of this invention are formed from the polyesterification product of dimethyl terephthalate and ethylene glycol and further made according to the teachings of Alles, U.S. Pat. No. 2,779,684 and Whinfield et al, U.S. Pat. No. 2,465,319 and the patents referred to in the specifications thereof. Other suitable films are the polyethylene terephthalate/isophthalates of British Pat. No. 766,290 and Canadian Pat. No. 566,672 and those obtained by condensing terephthalic acid and dimethyl terephthalate with propylene glycol, diethylene glycol, tetramethylene glycol or cyclohexane 1,4-dimethanol (hexahydro-p-xylene alcohol). The photographic film bases of Bauer et al, U.S. Pat. No. 3,052,543 may also be used. Films prepared from these polyesters are particularly suitable because of their dimensional stability and excellent optical clarity.

It is believed that energy treatment of the polyester base by electrical discharge, flame or chemical treatment creates active sites on the base surface which are believed to be carboxyl groups, and which in turn react with and couple to one of the aziridine groups of the polyfunctional aziridine hardener molecule, and other aziridine groups of the polyfunctional aziridine molecule crosslink to gelatin and/or the water-soluble polyester molecules. When a conventional aldehyde hardener such as formaldehyde is substituted for the aziridine in the formulation of this invention, poor base adhesion results, because aldehyde hardeners do not react with and couple to these active sites on the energy-treated base.

The coating weights of the subbing layer of this invention can vary widely. The lower limit is about 0.1 mg/dm$^2$ and the upper limit is set only by the amount which can be coated economically. However, the preferred range is 0.5–5 mg/dm$^2$. The coating can be applied to the polyethylene terephthalate base by any conventional coating technique, e.g., skim, bar coating, curtain and extrusion coating, followed by drying and thermal curing to effect the desired adhesion.

The subbing layer can be applied to one or both sides of the polyester support and can be coated with a layer comprising gelatin, e.g., a conventional silver halide emulsion system, e.g., gelatino-silver bromide, chloride, iodide, or mixtures of these; the silver halide emulsion can, of course, contain dyes, sensitizers, binders, and other additives conventional in the photographic art. Other polar coatings, aqueous or nonaqueous, can be applied in lieu of silver halide emulsions.

The invention is illustrated by the following examples, in which all amounts of materials are expressed in parts by weight unless otherwise indicated.

EXAMPLE 1

A polyester stock solution was made by dissolving in 1800 parts of distilled water 200 parts of a polyester prepared from a 1/1 mixture of (1) diethylene glycol and ethylene glycol, 80/20 mole percent respectively, and (2) a mixture of terephthalic acid, isophthalic acid, azelaic acid and sodium sulfonated isophthalic acid, 30/15/45/10 mole percent, respectively. To 33600 parts of distilled water the ingredients specified below were added, in the following order, while stirring:

| | |
|---|---|
| Bone gelatin - 10% aqueous stock solution | 1700 parts |
| Polyester stock solution | 1700 parts |
| Cetyl Betaine - 5% aqueous solution | 457 parts |
| Aqueous colloidal silica, 40% solids, ammonia stabilized | 164 parts |
| Neomycin Sulfate - 1% aqueous solution | 129 parts |
| Denatured ethyl alcohol | 2073 parts |
| 2.7N KCl solution | 101 parts |
| 1.5N NaOH solution | 9 parts |
| 0.63M Strontium nitrate solution | 128 parts |
| Trimethylolpropane tri-[β-(N-aziridinyl) propionate] | 34 parts |

This solution was coated on flame treated polyethylene terephthalate film and rapidly dried at 130° C., removing water and alcohol and effecting cure, to give a dry coating weight of 1.1 mg/dm$^2$.

Testing for wet and dry anchorage was performed by the following techniques. For dry anchorage a dry sample of sub-coated polyethylene terephthalate film was scribed in a line pattern so as to cut through the subbing layer and to expose a plurality of edges of the subbing layer. A piece of adhesive tape, one end of which was left unattached, was placed over the scribed area and rubbed several times with the finger to assure intimate contact. After a 15-minute wait, the tape was snapped rapidly, in one motion, off the scribed polyester support by pulling the unattached end of the tape. The tape did not pull off the subbing layer with it, thus demonstrating good dry adhesion of the subbing to the base.

For the wet anchorage test, which is more critical than the dry anchorage test because failure occurs more readily, a solution containing gelatin, formaldehyde hardener, and a Congo Red dye for visibility was coated over the clear subbed film support, dried for a few minutes under an air gun and aged at ambient conditions for twelve hours before testing. The dried sample was soaked in a water bath at 27° C. for about 10 seconds, to simulate temperature and time of processing in an automatic processor, and then scribed in a crosshatch pattern. The scribed sample was squeegeed and then rubbed ten times in a criss-cross motion with a wet paper towel. After rubbing, excess water was removed by squeegee and the sample was dried and examined for adhesion failure between the polyester base and the subbing layer. Clear areas were visible adjacent to some of the scribe marks, indicating that the gelatin containing the Congo Red dye had been removed. In order to determine whether the remaining substrate still retained the subbing attached to the polyester base, additional Congo Red dye was applied. The dye left a stain on the abovementioned clear areas. This proved that it had been absorbed by the gelatin-containing subbing layer, since the polyethylene terephthalate base was hydrophobic and would not stain.

A subbing layer composition made as above, but in which the water-soluble polyester was omitted, failed the wet anchorage test. A subbing layer composition made as above, but in which both the aziridine hardener and water-soluble polyester were omitted, failed both anchorage tests. A subbing layer composition made as above, but in which formaldehyde was used as a hardener instead of the aziridine, failed the wet anchorage test.

EXAMPLE 2

A subbing composition was made and coated on flame treated polyethylene terephthalate film in the same manner as Example 1 except the following ingredients were used:

| | |
|---|---|
| Distilled water | 251,600 parts |
| Gelatin stock solution of Example 1 | 19,200 parts |
| Polyester stock solution of Example 1 | 6,400 parts |
| Cetyl Betaine - 5% aqueous solution | 3,400 parts |
| Aqueous collodial silica, 40% solids, ammonia stabilized | 1,230 parts |
| Neomycin sulfate - 1% aqueous solution | 970 parts |
| Denatured ethyl alcohol | 15,600 parts |
| 2.7 N KCl | 760 parts |
| 0.63 M Strontium nitrate | 960 parts |
| Pentaerythritol tri-[beta-(N-aziridinyl) propionate] | 13 parts |

This sample was tested for both wet and dry anchorage by the methods described in Example 1 and it showed no failures in either test.

EXAMPLE 3

A subbing composition was made and coated on flame treated polyethylene terephthalate film in the same manner described in Example 2. All ingredients and amounts were identical to Example 2 except that in this example the aziridine was trimethylolpropane tri-[β-(N-aziridinyl) propionate] in the amount of 13 parts. This sample was tested for both wet and dry anchorage by the method described in Example 1 and it showed no failures in either test.

EXAMPLE 4

A photographic element using the single subbing system of this invention was prepared using a subbing composition composed as follows: First, a gelatin solution was made up with the following ingredients:

| | |
|---|---|
| Deionized water | 22,464 parts |

-continued

| | |
|---|---|
| Gelatin | 164 parts |
| Chromium sulfate | 2 parts |
| Cetyl Betaine - 5% aqueous solution | 220 parts |
| Aqueous colloidal silica, 40% solids, ammonia stabilized | 96 parts |
| 1.5N NaOH | 4 parts |
| Neomycin sulfate - 1% aqueous solution | 62 parts |
| Denatured ethyl alcohol | 999 parts |
| 2.7N KCl | 55 parts |

Then, to this solution was added:

| | |
|---|---|
| Water-soluble polyester stock solution of Example I | 1,540 parts |
| Trimethylolpropane tri-[β-(N-aziridinyl) propionate] | 41 parts |
| 0.63 M Strontium nitrate | 154 parts |

This composition was coated on flame treated polyethylene terephthalate base to give a dry coating weight of 1.3 mg/dm$^2$. Coated upon this single subbed base was a silver halide photographic emulsion. As a control, the same photographic emulsion was coated on the same type of base having a conventional dual subbing layer, i.e., a bottom layer of a copolymer of vinylidene chloride, and the second layer essentially a gelatin layer. After aging, both coatings were tested for dry and wet anchorage by the same methods as Example 1. Both samples exhibited no failures for dry anchorage, but in the wet anchorage test (described in Example 1), the control failed between the vinylidene chloride copolymer layer and the gelatin layer, whereas the single subbing system did not fail between the subbing layer and the support.

EXAMPLE 5

A photographic emulsion was coated over the subbing composition of this invention and tested for sensitometry. The subbing composition had been prepared from the following ingredients in the manner of Example 1:

| | |
|---|---|
| Distilled water | 878,300 parts |
| Gelatin stock solution of Example 1 | 50,400 parts |
| Water-soluble polyester stock solution of Example 1 | 17,200 parts |
| Cetyl Betaine - 5% aqueous solution | 8,860 parts |
| Denatured ethyl alcohol | 37,100 parts |
| Aqueous colloidal silica, 30% solids, ammonia stabilized | 1,700 parts |
| Neomycin sulfate - 1% aqueous solution | 2,500 parts |
| 60% aqueous colloidal dispersion of tetrafluoroethylene | 350 parts |
| 0.63 M Strontium nitrate | 2,500 parts |
| Trimethylolpropane tri-[β-(N-aziridinyl)-propionate] | 68 parts |

This composition was coated on a substrate composed of oriented and heat-set polyethylene terephthalate base film coated with conventional dual subbing layers as in Example 4. Then a photographic emulsion was coated on this. As a control the same photographic emulsion was coated on a polyethylene terephthalate film which had been precoated with the same dual subbing layers as in Example 4 but without the subbing layer of this invention. Both films were aged about 1 week at ambient conditions.

Both films were then placed between X-ray screens and given X-ray exposure through a conventional step wedge, development was in an automatic processor containing a standard hydroquinone X-ray developer; total processing time about 90 seconds. Densities were read on a densitometer, and sensitometry was calculated as normally done in the photogrphic art. The resulting sensitometry data, given below, shows that the aziridine does not affect photographic sensitivity.

| | Speed | Average Gradient | $D_{max}$ | Base + Fog |
|---|---|---|---|---|
| Control | 414 | 3.93 | 4.17 | 0.25 |
| Experiment | 426 | 3.78 | 4.21 | 0.24 |

EXAMPLE 6

A subbing composition was made and coated on flame treated polyethylene terephthalate film in the same manner as Example 1 except the following ingredients were used:

| | |
|---|---|
| Distilled water | 176,300 parts |
| Gelatin stock solution of Example 1 | 6,680 parts |
| Polyester stock solution of Example 1 | 6,680 parts |
| Cetyl betaine - 5% aqueous solution | 1,780 parts |
| Aqueous colloidal silica, 40% solids, ammonia stabilized | 344 parts |
| Neomycin sulfate - 1% aqueous solution | 500 parts |
| Denatured ethyl alcohol | 7,640 parts |
| 60% aqueous colloidal dispersion of tetrafluoroethylene | 73 parts |
| Trimethylolpropane tri[β-(N-{methylaziridinyl}) propionate] | 67 parts |

This sample was tested for both wet and dry anchorage by the methods described in Example 1 and it showed no failures in either test. This Example illustrates a 1:1 ratio of polyester:gelatin.

EXAMPLE 7

A subbing composition was made and coated on flame treated polyethylene terephthalate film in the same manner as Example 1 except the subbing solution was made up as described in Example 6 with the following differences:

Instead of 6,680 parts gelatin stock solution of Example 1, 4,676 parts were used.

Instead of 6,680 parts of polyester stock solution of Example 1, 8,684 parts were used.

Instead of 73 parts of colloidal dispersion of tetrafluoroethylene, 36 parts were used.

Instead of 67 parts of trimethylol propane tri-[β-(N-{methylaziridinyl}) propionate], 67 parts of trimethylol propane tri-[β-(N-aziridinyl) propionate] were used.

This sample was tested for both wet and dry anchorage by the methods described in Example 1 and it showed no failures in either test. This Example illustrates the use of about a 2:1 ratio of polyester-gelatin.

EXAMPLE 8

A subbing composition was made and coated on flame treated polyethylene terephthalate film in the same manner as Example 1 except the subbing solution was made up as described in Example 6 with the following differences:

Instead of 6,680 parts of gelatin stock solution of Example 1, 3,340 parts were used.

Instead of 6,680 parts of polyester stock solution of Example 1, 10,020 parts were used.

Instead of 73 parts of colloidal dispersion of tetrafluoroethylene, 36 parts were used.

Instead of 67 parts of trimethylol propane tri-[β-(N-{methylaziridinyl}) propionate], 94 parts of pentaerythritol tri-[β-(N-azirdinyl) propionate] were used. This sample was tested for both wet and dry anchorage by the methods described in Example 1 and it showed no failures in either test. This Example illustrates a 3:1 ratio of polyester:gelatin.

The excellent anchorage properties of the sub-coating of this invention, particularly the excellent wet anchorage, was surprisingly better than that of the gelatin/aziridine combination (without the water-soluble polyester). The water-soluble polyester would seem to have very few reaction sites with which the aziridine crosslinker can react, especially as compared to gelatin, which it partially replaces in the combination. In theory, the inherent compatibility in structure of the polyester film base and the water-soluble polyester adhesive might have been expected to contribute to the dry adhesion of the sub to the support but in the wet anchorage test, adhesion would have been expected to be no better than that of the gelatin-aziridine combination. The results in Example 1 were unexpected because they were to the contrary. Also, because the polyester employed in the sub was water-soluble as applied, it would have been expected that the sub layer would have loosened from the support under the rigorous conditions of the wet anchorage test, especially because of the small number of sites available for crosslinking.

When reference is made in the preceding description of the invention to flame treatment, chemical treatment, and electrical discharge treatment of the polyester support, it is to be understood that these are conventional terms in the art, and hence require not further description. Patents which illustrate such terms are U.S. Pat. Nos. 2,493,937; 3,072,483; 3,607,818; 3,753,765; and Canadian Pat. No. 684,658.

We claim:

1. An article of manufacture comprising an oriented heat-set energy-treated polyester shaped article carrying a layer of a reaction product of gelatin, a water-soluble polyester, and a polyfunctional aziridine.

2. The article of manufacture of claim 1 wherein the surface of said layer is coated with another layer comprising gelatin.

3. The article of manufacture of claim 1 wherein the oriented heat-set polyester is polyethylene terephthalate.

4. The article of manufacture of claim 1 wherein the oriented heat-set polyester shaped article is a film of polyethylene terephthalate.

* * * * *

UNITED STATES PATENT OFFICE

CERTIFICATE OF CORRECTION

PATENT NO. : 4,181,528

DATED : JANUARY 1, 1980

INVENTOR(S) : RAY A. WORK, III AND RICHARD N. PANKRATZ

It is certified that error appears in the above-identified patent and that said Letters Patent are hereby corrected as shown below:

| Column | Line | |
|---|---|---|
| 2 | 31 | "poly-functional" should be --polyfunctional-- |
| 3 | 16 | omitted in patent --trimethylolpropane tri-[β-(N-methylaziridinyl)-propionate]-- |
| 8 | 19-22 | These lines, beginning with "This sample" should form a separate paragraph |
| 8 | 48 | "not" should be --no-- |

Signed and Sealed this

*Fifteenth* Day of *July 1980*

[SEAL]

*Attest:*

SIDNEY A. DIAMOND

*Attesting Officer*

*Commissioner of Patents and Trademarks*